US008662478B1

(12) United States Patent
Jones, Jr.

(10) Patent No.: US 8,662,478 B1
(45) Date of Patent: Mar. 4, 2014

(54) PERIMETER BOUNDARY FOR CAMPGROUND AREA

(76) Inventor: Bonnie Jones, Jr., Cascade, VA (US)

( * ) Notice: Subject to any disclaimer, the term of this patent is extended or adjusted under 35 U.S.C. 154(b) by 148 days.

(21) Appl. No.: 13/269,637

(22) Filed: Oct. 10, 2011

(51) Int. Cl.
*E04H 17/14* (2006.01)

(52) U.S. Cl.
USPC ..... 256/25; 256/1

(58) Field of Classification Search
USPC ..... 256/1, 19, 21, 22, 24, 25, 26, 27, 73, 256/DIG. 6; 49/57; 52/184, 186
See application file for complete search history.

(56) References Cited

U.S. PATENT DOCUMENTS

| | | | | | |
|---|---|---|---|---|---|
| 174,973 | A * | 3/1876 | Parker | 256/26 |
| 197,806 | A * | 12/1877 | Walter | 256/26 |
| 2,581,318 | A * | 1/1952 | Bartlett | 256/25 |
| D188,112 | S * | 6/1960 | Winograd et al. | 256/19 |
| 4,628,635 | A * | 12/1986 | Maillard | 49/57 |
| 5,599,006 | A * | 2/1997 | Gevaux et al. | 256/25 |
| 6,182,948 | B1 * | 2/2001 | Brandeis | 256/19 |
| D579,574 | S * | 10/2008 | Cook et al. | D25/42 |
| 7,677,534 | B2 * | 3/2010 | Langenwalter | 256/26 |
| 2007/0158628 | A1 * | 7/2007 | Tsao | 256/19 |

* cited by examiner

*Primary Examiner* — Michael P Ferguson
(74) *Attorney, Agent, or Firm* — Gulf Coast Intellectual Property Group

(57) ABSTRACT

A perimeter boundary for a camping ground adjacent a conventional recreational camper that is operable to substantially inhibit a small child or pet from exiting the area defined by the perimeter boundary. The perimeter boundary further includes a plurality of panels having a first end and a second end and further including two horizontal support members and a plurality of longitudinal support members. The panels further include keepers mounted thereto on the first end and the second end. A multitude of connection members are provided that are generally rod shaped and function to releasably secure the plurality of panels. A stair panel is included that is formed so as to be mounted at least partially around stairs protruding from the recreational camper. A riser panel is further included to substantially cover the open riser area of the stairs of the recreational camper.

15 Claims, 2 Drawing Sheets

PERIMETER BOUNDARY FOR CAMPGROUND AREA

FIELD OF THE INVENTION

The present invention relates to a perimeter boundary for a camping area, more specifically but not by way of limitation, a portable fence adaptable to be placed adjacent a recreational camping vehicle and provide a boundary for small children and/or pets.

BACKGROUND

Millions of individuals regularly participate in outdoor activities such as but not limited too hiking and camping. In the United States there are thousands of state or national campgrounds that offer individuals a place to camp and experience the outdoors. Those that participate in camping often utilize a portable shelter such as but not limited to a tent in order to provide and structure to store gear and a place to sleep. Other individuals that engage in camping utilize recreational vehicles that offer significant amenities and can either be towed behind a truck or are equipped to be driven on their own.

Whether utilizing a tent or a recreational vehicle, all campers will temporarily set up an area adjacent to their portable structure commonly referred to as a campground. The campground area is typically utilized to prepare a fire or gather chairs and is the place where the individuals engaged in camping will gather.

Many state and national parks provide specific areas for recreational camping vehicles. These area traditionally have electric connections as well as water connections so as to provide the camper a comfortable environment. Individuals that utilize recreational camping vehicles will typically set up adjacent to their recreational vehicle chairs, tables and the like to utilize during their stay in the campground. One problem with campgrounds designed for recreational camping vehicles is the lack of a perimeter control. The campsites designed for recreational vehicles typically do not have any fencing or other structure that provide perimeter protection of the area immediately adjacent to the location of the recreational camping vehicle. Many campers utilizing recreational camping vehicles often have small children or pets. The lack of perimeter control of the campground area immediately adjacent the recreational camping vehicle thus requires a high degree of attention be given to pets or small children to ensure their safety.

Accordingly, there is a need for a portable perimeter boundary that can be placed adjacent to a recreational camping vehicle that provides a perimeter boundary for an area immediately adjacent to the recreational vehicle in order to provide limited space for a small child or pet to walk.

SUMMARY OF THE INVENTION

It is the object of the present invention to provide a portable perimeter boundary for an area immediately adjacent a recreational camper so as to limit an area of access for a child or a pet.

Another object of the present invention to provide a portable perimeter boundary for a camping area adjacent to a camping recreational vehicle that includes a plurality of rigid sections.

Yet another object of the present invention is to provide a portable perimeter boundary for a camping area adjacent to a recreational vehicle that includes a connection member that is operable to connect each of the plurality of sections.

Still another object of the present invention is to provide a portable perimeter boundary for a camping area adjacent to a recreational vehicle wherein the connection member further functions to be journaled into the ground so as to maintain the portable perimeter boundary in a substantially vertical position.

A further object of the present invention is to provide a portable perimeter boundary for a camping area adjacent to a recreational vehicle that includes a section adaptable to surroundably mount to the folding stairs of the recreational vehicle.

An additional object of the present invention is to provide a portable perimeter boundary for a camping area adjacent to a recreational vehicle that includes a portion that substantially closes the open riser area of the folding stairs of the recreational vehicle.

Yet a further object of the present invention is to provide a portable perimeter boundary for a camping area adjacent to a recreational vehicle that is durable and lightweight.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
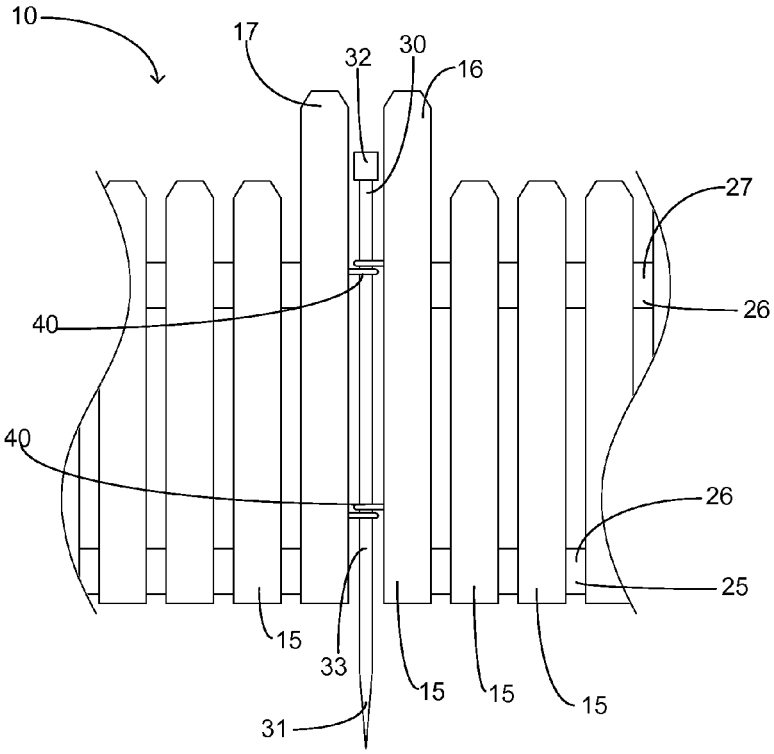
FIG. 1 is a detailed view of the connection member of the present invention operably coupling two panels.

Referring now to the drawings submitted herewith, wherein various elements depicted therein are not necessarily drawn to scale and wherein through the views and figures like elements are referenced with identical reference numerals, there is illustrated a campground perimeter boundary 100 constructed according to the principles of the present invention.

The campground perimeter boundary 100 further includes a plurality of panels 10 that are releasably secured to form the campground perimeter boundary 100. The panels 10 are constructed of a durable, rigid, lightweight material such as but not limited to plastic. The panels 10 include a plurality of longitudinal members 15 that are generally rectangular in shape. Each panel 10 further includes a first outer longitudinal member 16 and a second outer longitudinal member 17. The first outer longitudinal support member 16 and second outer longitudinal support member 17 are greater in length than the remaining longitudinal members 15 of the same panel 10. The first outer longitudinal support member 16 and second outer longitudinal support member 17 are greater in length than the longitudinal members 15 so as to provide a more stable interface with the connection member 30. The longitudinal members 15 of the panel 10 are secured in position against a first horizontal member 25 and a second horizontal member 27. The longitudinal members 15 are secured to the first horizontal support member 25 and second horizontal support member 27 utilizing suitable durable mechanical fasteners such as but not limited to nails or screws.

The longitudinal support members 15 are positioned such that they are evenly spaced along the first horizontal member and the second horizontal member 27. While good results have been achieved constructing a panel 10 that positions the longitudinal members 15 in a pattern such that a consistent space is intermediate each longitudinal member 15, it is contemplated within the scope of the present invention that the panels 10 could be constructed such that the longitudinal members 15 are adjacent to each other with no space intermediate thereto. While no particular length of the longitudinal members 15 is required, good results have been achieved utilizing longitudinal members 15 that are approximately three feet in length. Additionally, good results have been achieved utilizing a first outer longitudinal support member 16 and second outer longitudinal support member 17 that are approximately ten percent greater in length than the longitudinal members 15. While an exemplary panel 10 has been illustrated herein as having a first horizontal member 25 and a second horizontal member 27, it is further contemplated within the scope of the present invention that the panel 10 could have more than two horizontal members 26.

Referring in particular to FIG. 1, a connection member 30 is illustrated therein. The connection member 30 functions to releasably secure adjacent panels 10 during assembly of the campground perimeter boundary 100. The connection member 30 is manufactured from a suitable durable material such as but not limited to metal. The connection member 30 is generally rod-shaped having a first end 31 and a second end 32. The first end is generally tapered in shape so as to facilitate penetration thereof into the ground. The second end 32 is larger than the diameter of the body 33 of the connection member 30 so as to facilitate the engagement by a tool such as but not limited to a hammer when inserting the connection member 30 into the ground. While not illustrated herein, it is further contemplated within the scope of the present invention that the second end 32 be configured with threads similar fastener so as to have releasably secured thereto ornamental fixtures.

The connection members 30 are journaled through the keepers 40 during assembly of the campground perimeter boundary 100. The keepers 40 are mounted to the first outer longitudinal member 16 and second outer longitudinal member 17 utilizing suitable durable techniques such as but not limited to mechanical or chemical techniques. The keepers 40 are mounted such that they are generally perpendicular to the first outer longitudinal member 16 and second outer longitudinal member 17. While not illustrated herein, the keepers 40 include apertures so as to permit the connection member 30 to be journaled therethrough and releasably secured adjacent panels 10 as shown in FIG. 1.

Figure 3:
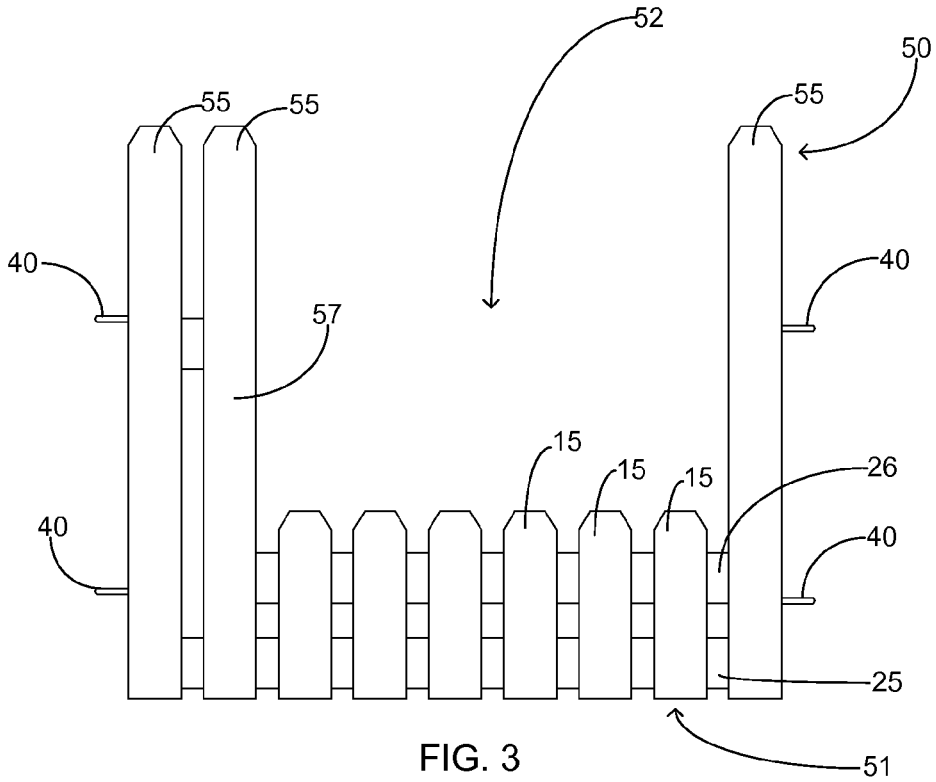
FIG. 3 is a front view of the stair panel of the present invention.

Illustrated in particular in FIG. 3 is a stair panel 50. The stair panel 50 is constructed to have a void 52 that is operable to accommodate the exemplary stairs 99 of a conventional recreational camper 98. The stair panel 50 includes three longitudinal support members 55. A first longitudinal support member 56 and second longitudinal support member 57 are adjacent each other, while the third longitudinal support member 58 is on the opposing side of the void 52. The stair panel 50 includes a lower portion 51 that is of suitable height to fit underneath the lowest tread 97 of the exemplary stairs 99 of the recreational camper 98. This substantially inhibits either a pet or small child to be able to escape the campground perimeter boundary 100 once assembled adjacent to the conventional recreational camper 98. The lower portion 51 consists of a plurality of longitudinal members 15 and a first horizontal member 25 and a second horizontal member 27 as described herein but modified so as to be placed such that the top 49 of the lower portion 51 is immediately adjacent the bottom of the lowest tread 97. Those skilled in the art will recognize that the lower portion 51 could be constructed in numerous different lengths so as to accommodate exemplary stairs 99 having different lower tread heights. It is further contemplated within the scope of the present invention that the lower portion 51 could be configured such that it is adjustable to accommodate different heights of lower tread of exemplary stairs 99 of conventional recreational campers 98. The stair panel 50 further includes a plurality of keepers 40 so as to be releasably secured to an adjacent panel 10 utilizing a connection member 30 during assembly of the campground perimeter boundary 100.

Figure 4:
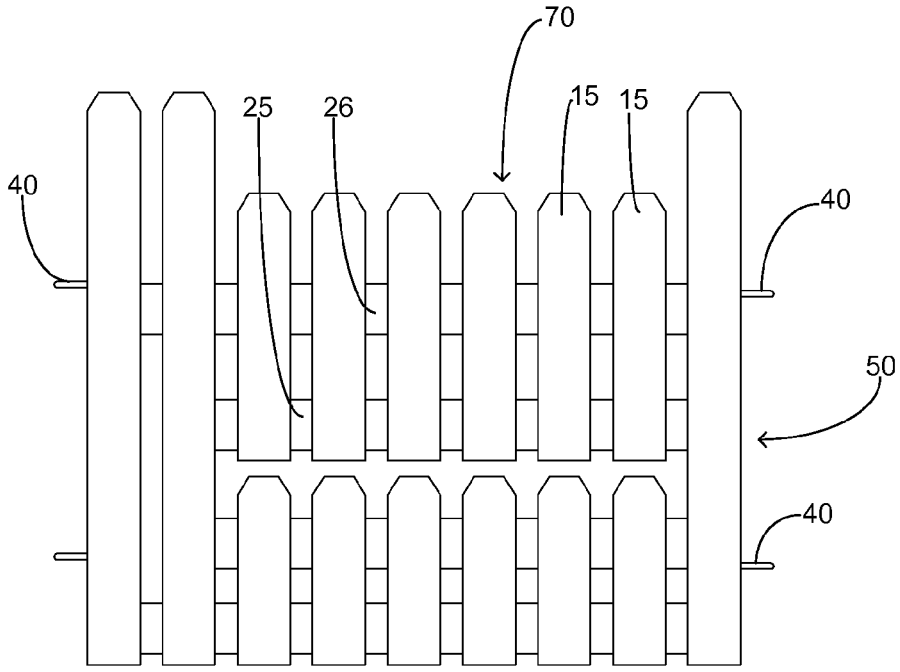
FIG. 4 is a front view of the stair panel of the present invention with the riser panel installed.

A riser panel 70 is illustrated in particular in FIG. 4. The riser panel 70 functions to substantially inhibit access through the open riser area intermediate the treads 96 of the exemplary stairs 99. Small children and or pets can potentially egress through the open riser area intermediate the treads 96. The campground perimeter boundary 100 includes the riser panel 70 and the stair panel 50 so as to substantially inhibit the ability of a small child or pet to egress from the campground perimeter boundary 100 once assembled adjacent to a recreational camper 98. The riser panel 70 includes a plurality of longitudinal members 15 and a first horizontal member 25 and a second horizontal member 27 as described herein but modified so as to be appropriately sized to be placed behind the exemplary stairs such that the riser panel 70 substantially encloses the open riser areas intermediate the treads 96. Those skilled in the art will recognize that the riser panel 70 could be constructed in numerous different sizes so as to accommodate various stairs 99 of different sizes having varying amounts of treads 96. Additionally, it is further contemplated within the scope of the present invention that the riser panel 70 could be constructed utilizing only one horizontal member. The riser panel 70 is releasably secured to the stairs 99 utilizing suitable durable fasteners.

Figure 2:
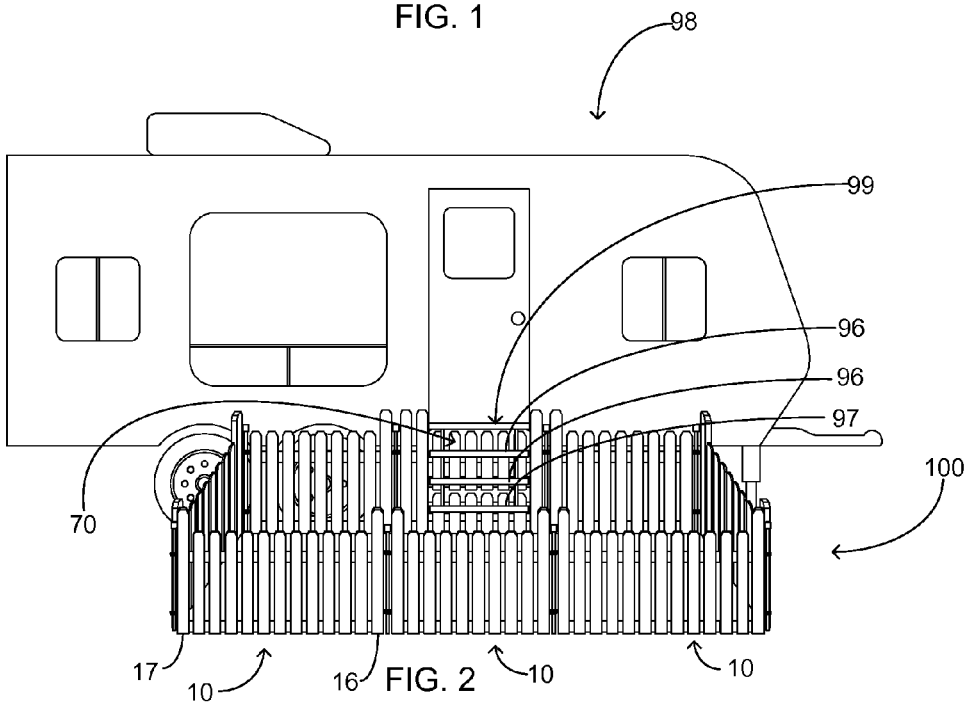
FIG. 2 is a perspective view of the present invention adjacent a conventional recreational camping vehicle.

Referring in particular to FIG. 2, a description of the operation of the campground perimeter boundary 100 is as follows. In use, the user will begin assembly of the campground perimeter boundary 100 by placing the panels 10 adjacent each other such that the first outer longitudinal support member 16 of one panel 10 is adjacent to the second outer longitudinal support member 17 of another panel 10. The keepers 40 are axially aligned such that the connection member 30 can be journaled therethrough and inserted into the ground. The panels 10 are assembled in a manner to outline an area immediately adjacent a recreational camper 98. During assembly the stair panel 50 is positioned such that the void 52 will be aligned with the extended stairs 99 and the lower portion 51 is substantially covering the area beneath the lowest tread 97. Ensuing assembly of the panels 10, the riser panel 70 is releasably secured into position such that it substantially covers the open riser areas intermediate the treads 96.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A perimeter boundary for a campground area adjacent to a recreational vehicle having retractable stairs having at least two treads with a front edge and a rear edge having open riser areas intermediate the at least two treads wherein the retractable stairs extend outwards from the recreational vehicle and towards the ground, comprising:

a plurality of perimeter panels each being generally rectangular in shape, said plurality of panels each including a multitude of pickets, said pickets being generally flat and oriented in a parallel manner, said plurality of panels further including at least two horizontal support rails, said at least two horizontal support rails being secured to said multitude of pickets, said at least two horizontal support rails being generally perpendicular with said multitude of pickets;

a stair panel including first and second vertical support members proximate opposing ends of said stair panel, a plurality of pickets intermediate said first and second vertical support members, and a horizontal support rail that is perpendicular to the plurality of pickets and said vertical support members and secured thereto, said pickets of said stair panel having a vertical height that is less than that of said vertical support members so as to define a void and to be placed generally underneath the retractable stairs, wherein said stair panel is operable to substantially cover a void between the retractable stairs of the recreational camper and the ground;

a plurality of connection stakes, each connection stake being securable between respective adjacent side edges of one of said perimeter panels and an adjacent said perimeter panel or said stair panel to releasably secure said plurality of perimeter panels and said stair panel to the ground; and a riser panel having at least one horizontal rail and a plurality of pickets secured thereto, said riser panel being releasably securable within said void in said stair panel to the retractable stairs proximate the rear edge of the at least two treads using fasteners, said riser panel operable to substantially cover open riser areas intermediate the at least two treads of the staircase.

2. The perimeter boundary as recited in claim 1, further including a plurality of keepers, said plurality of keepers secured to said side edges of said plurality of perimeter panels and said stair panel, said plurality of keepers configured to receive said plurality of connection stakes in order to facilitate the releasable securing of the plurality of perimeter panels and said stair panel.

3. The perimeter boundary as recited in claim 2, wherein the perimeter boundary is operable to define a contained space for access by a user and is further operable to restrict access to an area adjacent to the contained space.

4. The perimeter boundary as recited in claim 3, wherein said riser panel is operable to restrict access to an area adjacent to the contained space defined by the perimeter boundary that is underneath the recreational vehicle.

5. The perimeter boundary as recited in claim 4, wherein said plurality of perimeter panels are manufactured from a rigid material.

6. The perimeter boundary as recited in claim 5, wherein said plurality of perimeter panels are approximately three feet in height.

7. A perimeter boundary to be installed adjacent to a recreational camper having a staircase wherein the staircase has at least two treads with rear edges and front edges defining the width of the at least two treads having open riser areas intermediate the at least two treads, comprising:

a plurality of perimeter panels each having a first end and a second end, each of said plurality of panels including a first outer vertical support member proximate said first end and a second outer vertical support member proximate said second end, said plurality of panels each including a multitude of pickets intermediate said first and second outer vertical support members, said plurality of panels further including at least two horizontal support rails, said at least two horizontal support rails being secured to said multitude of pickets and said first and second outer vertical support members;

a stair panel having first and second vertical support members proximate opposing ends of said stair panel, said stair panel further including pickets intermediate said first and second vertical support members, said pickets of said stair panel having a vertical height that is less than that of said vertical support members so as to define a void located above said pickets and to be placed generally underneath the staircase from the recreational camper;

a plurality of connection stakes each having a first end and a second end, said connection stakes being generally rod-shaped, each connection stake being securable between respective adjacent side edges of one of said perimeter panels and an adjacent said perimeter panel or said stair panel to releasably secure said plurality of perimeter panels and said stair panel to the ground; and a riser panel having at least one horizontal member and a plurality of vertical members secured thereto, said riser panel being releasably securable within said void in said stair panel to the staircase proximate the rear edges of the at least two treads using fasteners, said riser panel operable to substantially cover open riser areas intermediate treads of the staircase.

8. The perimeter boundary as recited in claim 7, further including keepers, said keepers secured to said side edges of said plurality of perimeter panels and said stair panel, said keepers configured to receive said connection stakes in order to facilitate the releasable securing of the plurality of perimeter panels and said stair panel to form the perimeter boundary.

9. The perimeter boundary as recited in claim 8, said keepers being mounted to said first outer vertical support members and said second outer vertical support members in a generally perpendicular manner.

10. The perimeter boundary as recited in claim 9, wherein said multitude of pickets are oriented such that the space intermediate each of said multitude of longitudinal members is approximately equal.

11. A perimeter boundary operable to be assembled and placed adjacent to a recreational camper having a staircase wherein the staircase includes at least two treads with each tread having a rear edge and a front edge defining the width of the at least two treads and a riser area space intermediate each of the at least two treads, wherein the perimeter boundary defines and restricts access for small children and pets to an area outside of the perimeter boundary and inhibits access to an area underneath the recreational camper via the riser area space, comprising:

a plurality of perimeter panels each having a first end and a second end, and a top edge and a bottom edge, each of said plurality of panels including a first outer vertical support member proximate said first end and a second outer vertical support member proximate said second end, said plurality of panels each including a multitude of pickets intermediate said first and second outer vertical support members, said first and second outer vertical support members being approximately equal in length, said plurality of panels each further including two horizontal support rails, said two horizontal support rails being secured to said multitude of pickets and said first and second outer vertical support members;

a stair panel having a first and second vertical support members proximate opposing ends of said stair panel, said stair panel further including a third vertical support member proximate said second vertical support member, a plurality of pickets intermediate said first and third vertical support members, said plurality of pickets being the same length and forming a top edge, said pickets of said stair panel having a vertical height that is less than that of said vertical support members so as to define a void located above said top edge and to be placed generally underneath the staircase from the recreational camper;

a plurality of connection stakes each having a first end and a second end, said connection stakes each including a generally rod-shaped body, said second end being larger in diameter than said body, each connection stake being securable between respective adjacent side edges of one of said perimeter panels and an adjacent said perimeter panel or said stair panel to releasably secure said plurality of perimeter panels and said stair panel to the ground; and a riser panel having two horizontal rails and a plurality of pickets secured thereto, said riser panel being releasably securable within said void in said stair panel to the rear edge of the at least two treads of the staircase using fasteners and extending downward therefrom so as to cover the riser area space intermediate the at least two treads so as to inhibit access to an area generally underneath the recreational camper.

12. The perimeter boundary as recited in claim 11, wherein said first outer vertical support member and said second outer vertical support member of said plurality of perimeter panels are greater in length than said multitude of pickets.

13. The perimeter boundary as recited in claim 12, further including keepers, said keepers secured to said side edges of said plurality of perimeter panels and said stair panel, said keepers configured to receive said connection stakes in order to facilitate the releasable securing of the plurality of perimeter panels and said stair panel to form the perimeter boundary.

14. The perimeter boundary as recited in claim 13, wherein said keepers are mounted to said plurality of perimeter panels in a perpendicular mariner.

15. The perimeter boundary as recited in claim 14, wherein said riser panel is operable to inhibit access to an area underneath the recreational camper.

* * * * *